United States Patent [19]

Kimura

[11] Patent Number: 4,793,168

[45] Date of Patent: Dec. 27, 1988

[54] METHOD OF AND APPARATUS FOR EFFECTING A THICKNESS-REDUCTION ROLLING OF A HOT THIN PLATE MATERIAL

[75] Inventor: Tomoaki Kimura, Hitachi, Japan

[73] Assignee: Hitachi, Ltd., Tokyo, Japan

[21] Appl. No.: 36,864

[22] Filed: Apr. 9, 1987

[30] Foreign Application Priority Data

Apr. 14, 1986 [JP] Japan ..... 61-84140

[51] Int. Cl.[4] ..... B21B 45/04

[52] U.S. Cl. ..... 72/40; 29/81 A; 29/527.7

[58] Field of Search ..... 29/527.7, 527.5, 527.6, 29/33 S, 33 Q, 81 A, 81 B; 72/39, 40, 200, 201, 202, 237

[56] References Cited

U.S. PATENT DOCUMENTS

| | | | |
|---|---|---|---|
| 2,059,460 | 11/1936 | Iverson | 72/40 X |
| 2,163,699 | 6/1939 | Paul | 72/40 X |
| 2,197,022 | 4/1940 | Petterson | 72/40 X |
| 2,277,740 | 3/1942 | Yoder | 72/237 |
| 4,532,789 | 8/1985 | Bruinsma et al. | 72/202 |
| 4,698,897 | 10/1987 | Frommann et al. | 29/527.7 |

FOREIGN PATENT DOCUMENTS

| | | | |
|---|---|---|---|
| 1735623 | 12/1956 | Fed. Rep. of Germany . | |
| 58-25801 | 2/1983 | Japan | 72/40 |
| 58-122107 | 7/1983 | Japan . | |
| 58-157518 | 9/1983 | Japan | 72/40 |
| 58-163520 | 9/1983 | Japan | 72/40 |
| 59-50903 | 3/1984 | Japan | 72/39 |
| 59-116320 | 7/1984 | Japan . | |
| 60-115305 | 4/1985 | Japan . | |
| 60-108101 | 6/1985 | Japan . | |
| 60-115302 | 6/1985 | Japan . | |
| 60-124402 | 7/1985 | Japan . | |
| 193289 | 12/1964 | Sweden | 72/40 |
| 1117952 | 6/1968 | United Kingdom . | |

OTHER PUBLICATIONS

Patent Abstracts of Japan, vol. 3, No. 11 (C-35), 30 Jan. 79, 53137030 (Shin Nippon Seitetsu) 30 Nov. 78.

Patent Abstracts of Japan, vol. 6, No. 65 (M-124)(943), 24 Apr. 82, 577315 (Mitsubishi Jukogyo), 14 Jan. 82.

*Primary Examiner*—E. Michael Combs

*Attorney, Agent, or Firm*—Fay, Sharpe, Beall, Fagan, Minnich & McKee

[57] ABSTRACT

An apparatus for effecting a thickness-reduction rolling of a hot thin plate ingot provided with a continuous casting machine and a rolling mill has a widthwise rolling mill disposed between the continuous casting machine and the rolling mill for performing a width-reduction rolling of a thin plate ingot, and a bending device disposed between the widthwise rolling mill and the rolling mill for performing a bending work on the ingot in the longitudinal direction. The widthwise rolling mill applies a widthwise compressive strain to scale formed on the surface of the hot thin plate ingot and the bending device applies strain in the longitudinal direction thereof to thereby form intersecting cracks for fining the scale formed on the surface of the thin plate ingot. The scale is thereafter easily exfoliated by a relatively low pressure water descaling device without excessively lowering the temperature of the ingot.

15 Claims, 3 Drawing Sheets

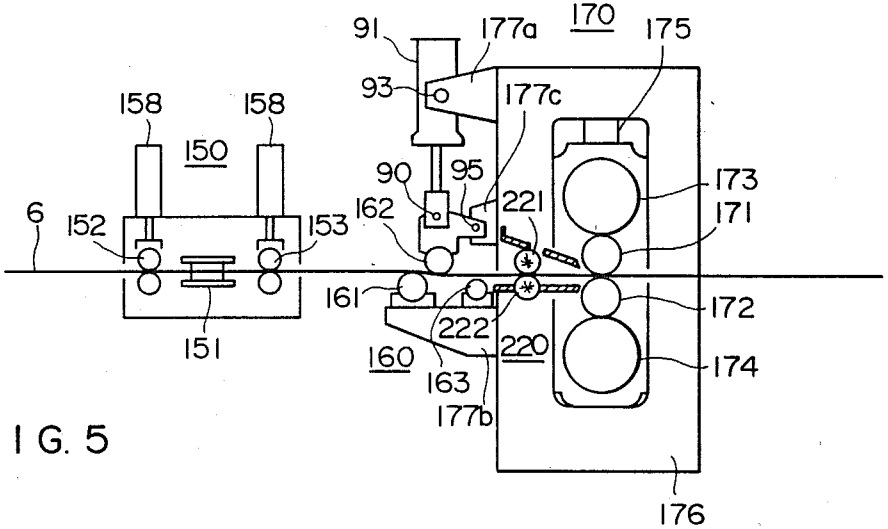
FIG. 4
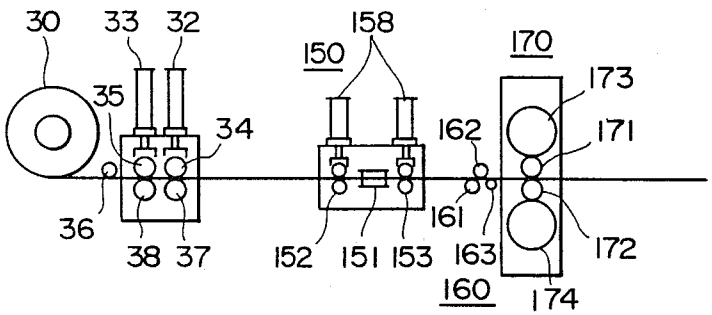
FIG. 5
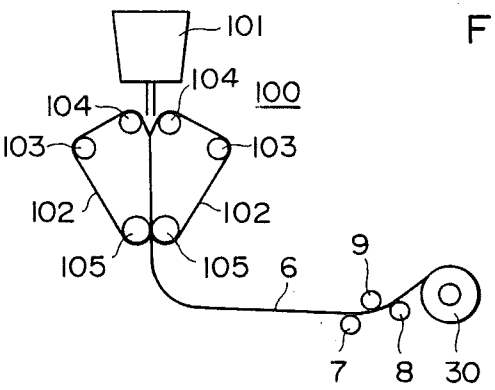

METHOD OF AND APPARATUS FOR EFFECTING A THICKNESS-REDUCTION ROLLING OF A HOT THIN PLATE MATERIAL

BACKGROUND OF THE INVENTION

The present invention relates to the technique thickness-reduction rolling of hot thin plate material, and more particularly to a technique of this kind which effects the thickness-reduction rolling of the thin plate material while suppressing a temperature drop of the thin plate material by effectively removing scale formed on the surface of the hot thin plate material.

A hot rolled thin plate has conventionally been manufactured as disclosed in Japanese Patent Application Laid-Open Publication No. 143949/77 by the method which comprises: rolling a slab having a thickness of 200 to 300 mm by a rougher disposed downstream of a widthwise rolling mill which rolls the slab in the direction Of width thereof, thereby obtaining a plate having a thickness of 20 to 40 mm; thereafter allowing the plate to pass through a descaling device jetting a high pressure water in the order of 150 kg/cm$^2$ so as to remove scale on the surface of the plate; and finish hot rolling the resulting plate thereby obtaining a thin plate product having a desired thickness.

With this method, however, since the plate material to be rolled is thin, the descaling by a high pressure water performed before the finish rolling causes a large temperature drop of the plate material. Thus, this method has a problem that it necessitates reheating of the plate material to be rolled and thus calls for consumption of an excessive amount of energy.

In particular, attempts have recently been made to continuously manufacture a thin plate ingot having a thickness of 20 to 40 mm by a continuous casting machine as disclosed in Japanese Utility Model Application Laid-Open Publication No. 56145/85, and when hot rolling the thin plate ingot by utilizing a casting sensible heat and thus without reheating, a temperature drop of the thin plate ingot during the descaling step becomes a problem. Therefore, it has become very important to develop a descaling technique which does not cause a large temperature drop.

That is, at an inlet side of a hot finishing mill it is necessary that the temperature of a material to be rolled is in the order of 1000° C.; but since the temperature of a thin plate ingot continuously obtained by the continuous casting has already reached a temperature of about 1000° C. before being rolled, it is a fatal problem that the temperature of the ingot is further lowered by high pressure water descaling. Since, in, general the temperature of a material to be rolled is lowered by about 80° to 100° C. by the high pressure water descaling, it is desirable to develop a descaling method which can suppress this temperature drop to a minimum. As an example of a descaling method which causes only a small temperature drop, a method in which the scale on the surface of a material to be rolled is mechanically removed by means of brushes in addition to bending roll has been known from Japanese Utility Model Application Laid-Open Publication No. 167421/77, but this method is not practical because the brushes are excessively worn, so that a further new descaling method is desired.

As disclosed in the above-mentioned Japanese Utility Model Application Laid-Open Publication No. 167421/77, a method is well known in which cracks are formed in the scale by cold bending the plate thereby enhancing an effectiveness for the pickling which is a post-treatment for removing the scale. However, in case where only this bending work is effected a series of cracks, each of which extends widthwise, are formed in the scale only in the plate's longitudinal direction, so that an amount of the scale exfoliated from the parent material is very small.

SUMMARY OF THE INVENTION

One of the objects of the present invention is to provide a method of and an apparatus for thickness-reduction rolling of a hot thin plate material that effectively removes scale formed on the surface of the hot thin plate material while suppressing a temperature drop of the hot thin plate material to thereby achieve energy-saving rolling by means of subjecting the thin plate material from which the scale has been removed to the thickness-reduction rolling.

The other of the objects of the present invention is to provide a method of and an apparatus for thickness-reduction rolling of a hot thin plate ingot that effectively removes scale formed on the surface of the thin plate ingot while decreasing a temperature drop of the hot thin plate ingot manufactured by a continuous casting machine thereby to carry out with energy-savings the thickness-reduction rolling of the hot thin plate ingot from which the scale has been removed.

The present invention provides a method of and an apparatus for effecting a thickness-reduction rolling of a hot thin plate material, in which—in order to accomplish the above-mentioned objects—the hot thin plate material is respectively subjected, before effecting a thickness-reduction rolling, to a width-reduction rolling in the direction of the plate's width and to a bending work in the plate's longitudinal direction to thereby apply a compressive strain and a bending strain to the scale formed on the surface of the hot thin plate material so as to form fine cracks in the scale. This causing the scale to be easily exfoliated from the thin plate material. Thereafter, the hot thin plate material from which the scale has been exfoliated is subjected to the thickness-reduction rolling by a rolling mill.

BRIEF DESCRIPTION OF THE DRAWINGS

FIG. 4 illustrates a second embodiment of the present invention and is a view showing, similarly to FIG. 3, a widthwise rolling mill, a longitudinal bending device and a brush device for removing scale, all of which are disposed within the thin plate hot rolling system shown in FIG. 1 as constituents of a descaling device and FIG. 5 is a schematic view showing a thin plate hot rolling system having a continuous casting machine, in accordance with a third embodiment of the present invention.

DESCRIPTION OF THE PREFERRED EMBODIMENTS

A hot thin plate rolling system having a continuous casting machine and a rolling mill in accordance with a first embodiment of the present invention will now be described with reference to the drawings.

Figure 1:
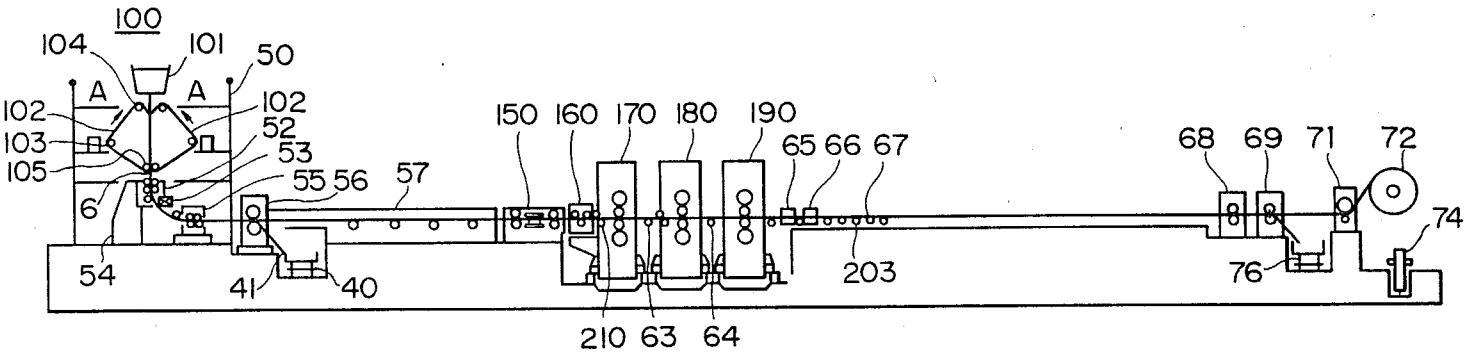
FIG. 1 a schematic view showing the arrangement of a thin plate hot rolling system having a continuous casting machine, in accordance with a first embodiment of the present invention.

FIG. 1 shows a hot rolled thin plate manufacturing system to which the present invention is applied.

In the system shown in FIG. 1, a material to be rolled is manufactured by a continuous casting machine 100 for manufacturing thin plate ingot. More specifically, molten metal in a tundish 101 is poured into a mold formed by two belts 102 and cooled therein. Each of these two belts 102 is guided by three belt guide rollers 103, 104 and 105 and circulates in the direction indicated by the arrow A, whereby a thin plate ingot 6 is continuously manufactured. This hot thin plate ingot 6 normally has sectional dimensions of 20 to 40 mm in thickness and 700 to 1600 mm in width and is continuously manufactured at a speed of 10 to 20 m per minute. The ingot has an average temperature of about 1100° C. after it is discharged from the mold formed by the belts 102. The ingot 6 which has been discharged from the mold formed by the belts 102 is then bent by a bending roller device 52 and unbent by an unbending device 55. The above-described belts 102 which form the mold and the bending and unbending devices 52 and 55 are supported by a rest 50, a supporting beam 53 and a supporting table 54.

The thus unbent ingot 6 is then subjected to a treatment in which defective parts of the ingot 6 such as those at the tip are cut off by a crop shear 56. Crop chute 41 and a crop car 40 are provided for disposing the crops resulting from this cutting treatment.

Since the thickness of the ingot 6 is small, the ingot 6 is passed through a heat insulating zone 57 of the tunnel furnace type, and is thus transferred through a housing that is closed tightly so as to prevent heat radiation as much as possible toward rolling mill stands 170, 180 and 190 which constitute the hot rolling mill.

Subsequently in this hot thin plate rolling system, descaling treatment on the thin plate ingot is performed prior to the rolling operation. In this descaling treatment, the thin plate ingot 6 is firstly rolled in the direction of width thereof by a widthwise rolling mill 150, whereby a series of cracks, each of which extends in the longitudinal direction, are formed in the scale formed on the surface of the thin plate ingot 6 owing to the compressive strain applied widthwise to the thin plate ingot 6. Next, the thin plate ingot 6 is bent in the longitudinal direction thereof by a bending device 160, whereby a series of cracks, each of which extends widthwise, are formed in the longitudinal direction thereof. The scale which thus became easy to be exfoliated by the formation of cracks is then jetted off by a fluid jet device 210 and descaled from the parent material. The temperature drop of the thin plate ingot which takes place between the time when the ingot is discharged from the mold formed by the belts 102 and the completion of the descaling is about 100° C.

After having been subjected to the descaling treatment, the ingot is then subjected to a thickness-reduction rolling by the three rolling mills 170, 180 and 190 so as to obtain various plate thicknesses which are within the range of 1.6 to 12 mm in accordance with requirements.

Tension adjusting devices 63 and 64 are provided between the rolling mill stands 170, 180 and 190 for the purpose of setting the tension of the plate.

The bending device 160 is disposed on the inlet side of the rolling mill stand 170 and is used to remove the scale particularly formed between the stands when rolling at low speed.

The thin plate 67 rolled by the rolling mills 170, 180 and 190 into a predetermined plate thickness is transferred by table rollers 203. As occasion demands, devices such as a plate thickness measuring device 65 and a plate configuration or plate section configuration measuring device 66 are provided on the outlet side of the final rolling mill stand 190, so that the roll bending force and the rolling force may be controlled on the basis of the values detected by these detectors.

Pinch rollers 68 apply a predetermined tension to the thin plate 67 transferred by the table rollers 203, and the thin plate 67 is coiled after passing through pinch rollers 71 which apply a predetermined tension to a coiler 72. After the thin plate 67 is coiled until it assumes a predetermined size, the plate is cut and divided by a parting shear 69. Unnecessary parts of the plate such as those at the tip are disposed by a crop car 76.

By means of the rolling system described above, the thin plate from which the scale has been effectively removed is continuously manufactured by hot rolling with an energy-savings.

Figure 2:
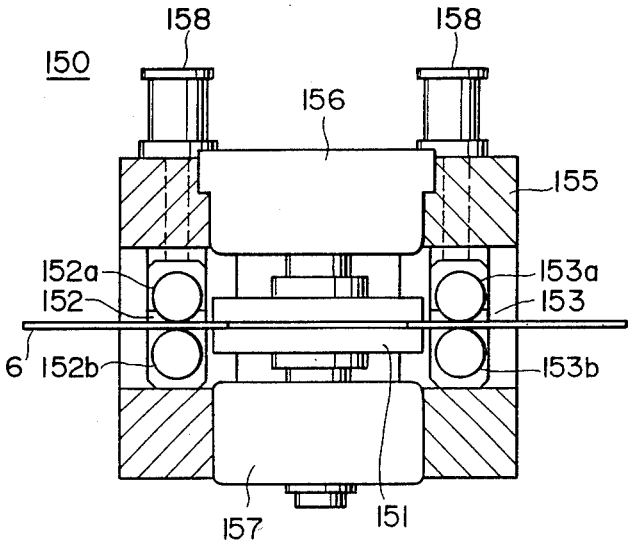
FIG. 2 is a sectional view showing details of a widthwise rolling mill disposed within the thin plate hot rolling system shown in FIG. 1.
Figure 3:
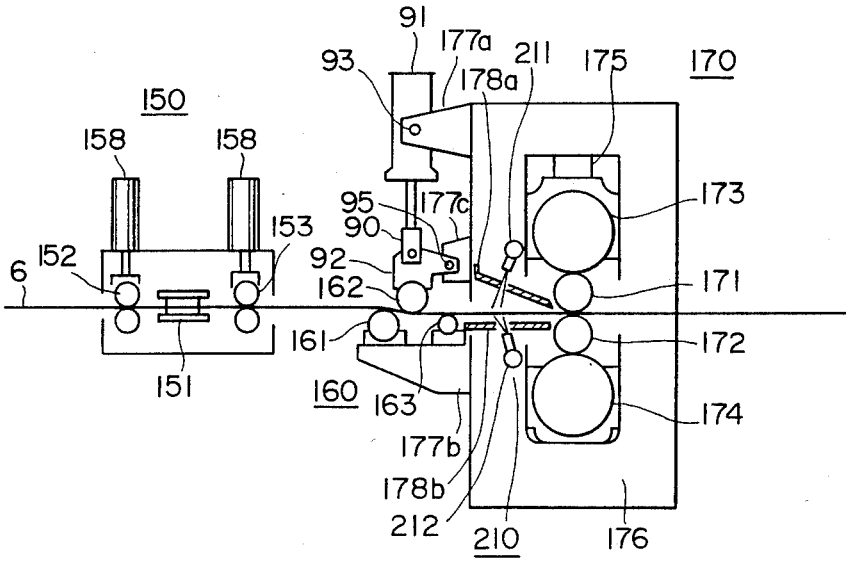
FIG. 3 is a structural view showing a widthwise rolling mill, a longitudinal bending device and a fluid jet device for removing scale, all of which are disposed within the thin plate hot rolling system shown in FIG. 1 as constituents of a descaling device.

Next, with reference to FIGS. 2 to 4, a detailed explanation is provided about the widthwise rolling mill 150 and the bending device 160 for the thin plate ingot, and about the fluid jet device 210 or the brush device 220 for removing the scale from the thin plate ingot, all of which are provided in the hot thin plate rolling system shown in FIG. 1.

In FIG. 2, the thin plate ingot 6 manufactured by the continuous casting machine is firstly rolled widthwise by the widthwise rolling mill 150. In this widthwise rolling mill 150, a pair of widthwise rolling rolls 151 are disposed in a housing 155 so as to roll the thin plate ingot 6 widthwise. Further, two pairs of pinch rollers 152 and 153 are disposed upstream and downstream of the widthwise rolling rolls 151 for the purpose of preventing the ingot from buckling while it is being rolled widthwise.

The two pairs of pinch rollers 152 and 153 are composed of lower rollers **152*b* and 153*b*, and upper rollers 152*a* and 153*a*, respectively, and the upper rollers 152*a* and 153*a* are arranged to be screwed down by each of cylinders 158. With this widthwise rolling mill 150, a reduction in width within the range of about 10 to 80 mm is effected in accordance with the required plate width of the product. By effecting this reduction in width, a series of cracks, each of which extends in the longitudinal direction, are formed in the scale in the direction of the plate width. Thereafter, as shown in FIG. 3, the thin plate ingot 6 is bent by bending rollers 161, 162 and 163 constituting the bending device 160, whereby a series of cracks, each of which extends widthwise, are formed in tee scale in the longitudinal direction of the plate. The lower bending rollers 161 and 163 disposed below the ingot are supported by a bracket 177*b* provided on a rolling stand 176 constituting the first-stage rolling mill 170. The upper bending roller 162 is supported by an arm 92 pivoted to a bracket 177*c* through a pin 95, and is also connected to fork end 90 of a cylinder 91 pivoted to a bracket 177*a* through a pin 93 so as to be vertically moved by the operation of the cylinder 91 and thus to be able to bend the thin plate ingot 6 in the longitudinal direction. The rolling mill 170 has the housing 176 in which are disposed upper and lower work rolls 171 and 172, upper and lower back-up rolls 173 and 174, a screw down position determining device 175**, and so forth.

By thus applying the strains widthwise and in the longitudinal direction to the thin plate ingot 6, cracks are formed in the scale in a manner as mentioned before, thereby the scale becomes very easily exfoliated.

That is, in the foregoing embodiment in accordance with the present invention, by applying the strains both widthwise and in the longitudinal direction to the thin plate ingot before being rolled to thereby form a series of cracks in the scale on the surface of the ingot widthwise and in the longitudinal direction by means of utilizing a difference in elongation rupture value between the scale formed on the surface of the ingot and the ingot itself or the parent material, i.e. by means of utilizing a property that the scale is scarcely elongated, the scale is caused to be easily exfoliated from the parent material.

In other words, in effecting a removal of the scale prior to effecting a thickness-reduction rolling of a hot thin plate material, it is intended to effectively form the cracks in the scale, and in order to form a series of cracks in the plate's longitudinal direction the bending work on the thin plate material is adopted. However, since the scale cannot be sufficiently exfoliated from the parent material only by this bending work, the width-reduction rolling is further effected widthwise to thereby apply the compressive strain so as to form the fine cracks in the scale, whereby an exfoliation effect for the scale is promoted.

More specifically, by applying the bending strain in the longitudinal direction, only a series of long cracks, each of which extends widthwise, are formed in the scale on the thin plate ingot. Since a pitch of these cracks in the longitudinal direction is in the order of 20 to 100 μm, a size of the cracked scale after the bending work treatment becomes 20–100 μm×plate width. Since the plate width is normally about 700 to 1600 mm, the scale divided by the cracks is too large, so it cannot be effectively exfoliated from the parent material when only bending work is performed on the ingot.

Therefore, in the embodiment of the present invention, in addition to applying a bending strain in the plate's longitudinal direction, compressive strain is applied widthwise by the widthwise rolling rolls whereby a series of cracks are also formed lengthwise in the scale attached to the surface of the parent material of the thin plate ingot. By virtue of the two actions of the bending work and the widthwise rolling mentioned above, the size of the cracked scale becomes finer-approximately to 20–100 μm square. By thus dividing the area over which the scale is attached to the parent material of the thin plate ingot into small divisions, the scale becomes easy to be exfoliated from the parent material of the thin plate ingot. Thus, the scale can be removed or descaled from the parent material by the application of a small force. Such as by the above-described brushes or by jetting a low pressure water or vapor.

Generally, the descaling effects on the thin plate ingot achieved by the width-reduction rolling by the widthwise rolling mill 150 and the longitudinal bending by the bending device 160 are as follows.

The cracks formed in the scale on the surface of the ingot by the width-reduction are formed in such a tendency that they are remarkable in the vicinity of the plate's width ends while they are gradually decreased in going toward the central portion.

In general, although the descaling in the vicinity of the plate's width ends is difficult, by the width-reduction mentioned above the effect that the descaling in the vicinity of the plate's width ends is assured can be obtained. On the other hand, the descaling effect by the longitudinal bending is low at the plate's width end faces because the bending strain is zero at the center of the end faces.

However, since the bending strain is maximum on the plate's surface, the longitudinal bending can provide the descaling effect on the plate's entire surface except portions in the vicinity of the end faces. In this way, according to the present invention, the remarkable descaling effects are provided by the two different actions.

Preferably, the two scale crack forming devices constituted by the widthwise rolling mill 150 and the bending device 160 which apply the strains widthwise and in the longitudinal direction respectively to the thin plate ingot should be so arranged that at least one of these devices is disposed just before the inlet of the hot rolling mill. This is because the scale may be newly formed in the portions at which the cracks have been formed, as the time elapses. However, because the newly formed scale is thin, it is considered that the descaling effect may not be greatly impaired even if the device is disposed somewhat away from the rolling mill.

Among these scale crack forming devices, the bending work in the plate's longitudinal direction can provide generally a greater crack forming effect than the widthwise rolling, because the former can apply a sufficient working curvature irrespective of a product size. This is because in the width-reduction an amount of the widthwise rolling is limited by the reasons of preventing the plate from buckling and also of the plate's required width.

From the above-described view points, it is preferable to dispose the bending device 160 just before the inlet of the rolling mill stand 170 and to dispose the widthwise rolling mill 150 further before this bending device 160. However, in the hot rolling system shown in FIG. 1, it is desirable to dispose the device 150 downstream of the heat insulation zone 57. This is because, in order to perform uniform widthwise rolling, it is preferable to roll the plate material after the temperature thereof has been made as uniform as possible by the heat insulation zone 57. Needless to say, the widthwise rolling may be performed on the inlet side of the heat insulation zone 57 shown in FIG. 1.

Although in the system shown in FIG. 1 the devices for forming cracks in the scale on the surface of the ingot are disposed in the order of the widthwise rolling mill and then the bending device, it is obvious from the gist of the present invention that even if this order is reversed the same effects can be obtained.

The cracked scale which thus became easy to be exfoliated is blown off by a jet of water or vapor under a low pressure in the order of 10 kg/cm$^2$ which is jetted from jet nozzles 211 and 212 constituting the fluid jet device 210 disposed within the rolling mill stand 176, thereby completing the descaling.

Preferably, the jet nozzles 211 and 212 should be disposed as close as possible to the work rolls 171 and 172 of the rolling mill 170, so that as shown in FIG. 3, the fluid jets are jetted onto the surface of the thin plate ingot 6 through the respective gaps formed in the plate guides **178*a* and 178*b***.

Alternatively, as shown in FIG. 4 the scale may be removed by using, in place of the fluid jet device, brushes 221 and 222 which constitute a mechanical removing device 220.

Also in this case, since the scale has become easy to be removed, the pressing forces of the brushes 221 and 222 may be small, so that the wear of the brushes can be extremely reduced.

The upper and lower work rolls 171 and 172 are supported by the back-up rolls 173 and 174, respectively, and the upper back-up roll 173 is constructed so as to be vertically movable by the screw down position determining device 175.

FIG. 2 is a front view of the widthwise rolling mill employed in the hot rolling system in accordance with the embodiment of the present invention. A pair of widthwise rolling rolls 151 are set at both width ends of the thin plate ingot 6 so as to grip and press the latter widthwise.

More specifically, the widthwise rolling rolls 151 are supported by upper and lower bearing boxes 156 and 157 and are mounted on a stand 155 so as to be movable widthwise. The upper and lower bearing boxes 156 and 157 are pressed widthwise by means of screws or cylinders (not shown), and as a result the widthwise rolling rolls 151 effect a width-reduction rolling so as to reduce the width of the thin plate ingot 6.

Front side pinch rollers 152 and rear side pinch rollers 153 ar also accommodated within the stand 155 and, as mentioned before, the respective upper pinch rollers 152*a* and 153*a* are arranged so as to be screwed down by the respective cylinders 158.

With the above-described descaling method, in FIG. 1 the temperature drop during the time from when the thin plate ingot is discharged from the mold formed by the belts 102 to the completion of the descaling is about 100° C. as mentioned before and, among this temperature drop, that attributable to the descaling is about 20° to 30° C. Thus, when compared to a conventional descaling method which employs a jet of high pressure water of 150 Kg/cm$^2$ and which thus causes the temperature drop of about 100° C. during the descaling, the descaling method of the present invention is able to suppress the temperature drop to a level of about one third or one forth of that caused by the conventional method, and thus it becomes unnecessary to reheat the thin plate ingot in a subsequent rolling step, thereby achieving an effect of energy-saving.

A further embodiment of the present invention as applied to a hot rolling system will now be described with reference to FIG. 5. In this embodiment, after a thin plate ingot 6 has been manufactured by a continuous casting machine, it is once coiled so as to obtain a hot coil 30. Thereafter, the hot coil 30 is uncoiled and is then subjected to thickness-reduction rolling by means of rolling mil 170, etc. In the system of this embodiment, the thin plate ingot 6 is obtained, in the same way as in the system shown in FIG. 1, by using a continuous casting machine in which a melt discharged from a tundish 101 is cooled in a mold formed by two belts 102. The thus obtained thin plate ingot 6 is bent by bending rollers 7, 8 and 9, thereby obtaining a hot coil 30. The hot coil 30 is then transferred to the rolling line in which it is firstly unbent and rolled.

The unbending of the coil 30 is performed by five unbending rollers 34, 35, 36, 37 and 38. The upper unbending rollers 34 and 35 are arranged so as to be movable vertically by the respective cylinders 32 and 33 for adjusting an amount of the bending.

Thereafter, the descaling treatment to the coil 30 is performed before rolling. Firstly, by the widthwise rolling rolls 151 in the widthwise rolling mill 150 the unbent thin plate ingot is subjected to the width-reduction rolling in which the width of the ingot is reduced. As mentioned before with reference to FIG. 2, the lower pinch rollers 152*b* and 153*b* as well as the upper pinch rollers 152*a* and 153*a* vertically movable by the respective cylinders 158 are provided upstream and downstream of the widthwise rolling rolls 151. In the inlet side of the work rolls 171 and 172 in the rolling mill 170 which rolls the thin plate ingot having passed through the widthwise rolling mill 150, the bending rollers 161, 162 and 163 constituting the bending device 160 are provided, and thus the scale formed on the surface of the thin plate ingot is cracked and exfoliated. The thin plate ingot from which the scale has been removed is then rolled by the rolling mill 170, etc. to a desired plate thickness.

Although in the foregoing two embodiments a thin plate ingot manufactured by a continuous casting machine is used as the material to be rolled, the present invention may be executed as the descaling devices disposed in front of a finish rolling mill in a conventional rolling system in which the rolling is effected starting from a slab.

By the technique for effecting a hot rolling of a hot thin plate in which the above-mentioned descaling is applied, the following effects are obtained.

1. Since the scale formed on the surface of the hot thin plate material is finely cracked and made easy to be exfoliated while suppressing the temperature drop of the hot thin plate material and thereafter this hot thin plate material from which the scale has been removed is subjected to a thickness reduction rolling, it is possible to achieve an energy-savings in hot rolling.
2. The scale formed on the surface of the hot thin plate ingot manufactured by a continuous casting machine is finely cracked and thus made easy to be exfoliated while reducing the temperature drop of the hot thin plate ingot. Thereafter this hot thin plate ingot from which the scale has been removed is subjected to a thickness-reduction rolling. Therefore, it is possible to actualize an integrated rolling system comprising the continuous casting machine and the rolling mill in which an energy-saving is aimed at.

Further, by the above-mentioned embodiments of the present invention it is also possible to achieve the following effects.

3. Since the scale is removed from a thin plate material under a condition in which the scale can be easily exfoliated without using a high pressure water for descaling, the temperature drop from a temperature desired when rolling the thin plate material is reduced to 20–30° C, in comparison with about 100° C. in the prior art.
4. Since the jet spray pressure for removing the scale from a hot thin plate material may be in the order of 10 kg/cm$^2$ in comparison with about 150 kg/cm$^2$ in the prior art, the scale can be removed with a small energy. Further, when brushes are used, the life of the brushes can be prolonged.
5. The widthwise rolling applied here not only improves the descaling effect on a hot thin plate material but also brings about an effect of performing the widthwise rolling at the same time.

In consequence, according to the present invention, by applying—prior to a thickness-reduction rolling—the strains both in the direction of width and in the longitudinal direction to the scale formed on the surface of a hot thin plate material or a hot thin plate ingot without causing a large temperature drop, the fine cracks are formed in the scale thereby causing the scale to be easily exfoliated from the thin plate material or the thin plate ingot and thereafter the hot thin plate material or the thin plate ingot from which the scale has been removed is subjected to the thickness-reduction rolling. Therefore, the hot rolling system of the invention which can be provided with a continuous casting machine, has excellent energy-savings.

I claim:

1. A method of effecting a thickness-reduction rolling of a hot thin plate material, comprising the steps of:

drawing a hot thin plate material manufactured by a continuous casting machine out of the continuous casting machine in hot state;

performing a widthwise rolling of said hot thin plate material in the direction of width thereof thereby applying a compressive strain to scale formed on the surface of said hot thin plate material, and further performing a bending work of said hot thin plate in the longitudinal direction thereof thereby applying a bending strain to said scale on the surface of said thin plate material and thereafter exfoliating said scale from said thin plate material; and effecting by a rolling mill a thickness-reduction rolling of said hot thin plate material from which said scale has been exfoliated.

2. A method of effecting a thickness-reduction rolling of a hot thin plate ingot manufactured by a continuous casting machine, comprising the steps of:

performing a width-reduction rolling of a hot thin plate ingot continuously manufactured by a continuous casting machine in the direction of width thereof thereby applying a compressive strain to scale formed on said hot thin plate ingot, and teen further performing a bending work of said hot thin plate ingot in the longitudinal direction thereof thereby applying a bending strain to said scale on the surface of said thin plate ingot and thus fining the cracks formed in said scale on the surface of said thin plate ingot so as to promote the exfoliation of said scale from said thin plate ingot; and thereafter, by a rolling mill, effecting a thickness-reduction rolling of said hot thin plate ingot from which said scale has been exfoliated.

3. A method according to claim 2, wherein said thin plate ingot manufactured by said continuous casting machine is first coiled in hot state into a coil form and thereafter subjected to said steps of performing width-reduction rolling and bending work in the longitudinal direction thereof.

4. A method of effecting a thickness-reduction rolling of a hot thin plate material, comprising the steps of:

drawing a hot thin plate material manufactured by a continuous casting machine out of the continuous casting machine is hot state;

performing a widthwise rolling of said hot thin plate material in the direction of width thereof thereby applying a compressive strain to a scale formed on the surface of said hot thin plate material and thus forming cracks in the scale, and performing a bending work of said hot thin plate material in the longitudinal direction thereof thereby applying a bending strain to said scale on the surface of said thin plate material for thus fining said cracks;

exfoliating said scale having said cracks by a fluid means or a mechanical means; and thereafter, by a rolling mill, effecting a thickness-reduction rolling of said hot thin plate material from which said scale has been exfoliated.

5. An apparatus for effecting a thickness-reduction rolling of a hot thin plate ingot provided with a continuous casting machine and a rolling mil, comprising:

a widthwise rolling mill disposed between said continuous casting machine and said rolling mill for effecting a thickness-reduction rolling of a thin plate ingot, said widthwise rolling mill being adapted to perform a width-reduction rolling of a hot thin plate ingot continuously manufactured by said continuous casting machine thereby applying a widthwise compressive strain to scale formed on the surface of said hot thin plate ingot; and means for performing a bending work of said hot thin plate ingot in the longitudinal direction thereof for fining said scale formed on the surface of said thin plate ingot;

means for exfoliating said scale from said thin plate ingot; and rolling mill means for effecting a thickness-reduction rolling of said hot thin plate ingot rom which said scale has been thus removed.

6. An apparatus according to claim 5, wherein said widthwise rolling mill has widthwise rolling rolls for effecting said width-reduction rolling of said hot thin plate ingot and pinch rolls provided respectively on the front and rear sides of said widthwise rolling rolls along the longitudinal direction of said ingot, and wherein said bending work means has upper and lower bending rollers disposed in a zigzag configuration above and below said thin plate ingot and means for vertically moving one of said bending rollers.

7. An apparatus according to claim 5, further comprising:

a coiler means for coiling in hot state said hot thin plate ingot into a coil form and an uncoiler means for uncoiling said hot thin plate ingot coiled by said coiler means into a plate form are respectively disposed between said continuously casting machine and said widthwise rolling mill.

8. An apparatus according to claim 5, wherein said widthwise rolling mill is disposed upstream of said rolling mill at a location which is further upstream of said bending work means.

9. An apparatus according to claim 5, further comprising:

said widthwise rolling mill having widthwise rolling rolls for effecting said width-reduction rolling of said hot thin plate ingot and pinch rolls provided respectively on the front and rear sides of said widthwise rolling rolls along the longitudinal direction of said ingot;

said bending work means having upper and lower bending rolls disposed in a zigzag configuration above and below said thin plate ingot and means for vertically moving one of said bending rollers, and said exfoliating means being a fluid jet means or a brush means for exfoliating said scale.

10. An apparatus according to claim 9, wherein said fluid jet means or said brush means is disposed upstream of work rolls in a first stage stand of said rolling mill.

11. An apparatus for effecting a thickness-reduction rolling of a hot thin plate material provided with a rolling mill for rolling a hot thin plate material, comprising:

a continuous casting machine for continuously manufacturing a hot thin plate material directly from a melt;

widthwise rolling mill means disposed downstream of said continuous casting machine and upstream of said rolling mill for performing a width-reduction rolling of a hot thin plate material and for applying a widthwise compressive strain to a scale formed on the surface of said hot thin plate material; and means for performing a bending work of said hot thin plate material in the longitudinal direction thereof and for forming fine cracks in said scale formed on the surface of said thin plate material;

exfoliating means for removing said scale from said thin plate material; and said rolling mill effecting a thickness-reduction rolling of said hot thin plate material from which said scale has been thus removed.

12. An apparatus according to claim 11, wherein said widthwise rolling mill has widthwise rolling rolls for effecting said width-reduction rolling of said hot thin plate material and pinch rolls provided respectively on the front and rear sides of said widthwise rolling rolls along the longitudinal direction of said thin plate material, and wherein said bending work means has upper and lower bending rollers disposed in a zigzag configuration above and below said thin plate material and means for vertically moving one of said bending rollers.

13. An apparatus according to claim 11, wherein said widthwise rolling mill is disposed upstream of said rolling mill at a location which is further upstream of said bending work means.

14. An apparatus according to claim 11, further comprising:

said widthwise rolling mill having widthwise rolling rolls for effecting said width-reduction rolling of said hot thin plate material and pinch rolls provided respectively on the front and rear sides of said widthwise rolling rolls along the longitudinal direction of said thin plate material, said bending work means having upper and lower bending rolls disposed in a zigzag configuration above and below said thin plate material and means for vertically moving one of said bending rollers, and said exfoliating means being a fluid jet means or a brush means for exfoliating said scale on the surface of said thin plate ingot that has been fined.

15. An apparatus according to claim 14, wherein said fluid jet means rr said brush means is disposed upstream of work rolls in a first stage stand of said rolling mill.

* * * * *